US006049348A

United States Patent [19]

Spurr

[11] Patent Number: 6,049,348

[45] Date of Patent: Apr. 11, 2000

[54] PROGRAMMABLE GEARING CONTROL OF A LEADSCREW FOR A PRINTHEAD HAVING A VARIABLE NUMBER OF CHANNELS

[75] Inventor: Robert W. Spurr, Rochester, N.Y.

[73] Assignee: Eastman Kodak Company, Rochester, N.Y.

[21] Appl. No.: 09/144,396

[22] Filed: Aug. 31, 1998

[51] Int. Cl.[7] ..... B41J 2/435

[52] U.S. Cl. ..... 347/234

[58] Field of Search ..... 347/234, 248, 347/37, 19; 346/139 D; 400/322, 323, 323.1, 328

[56] References Cited

U.S. PATENT DOCUMENTS

| | | | |
|---|---|---|---|
| 4,115,726 | 9/1978 | Patterson et al. | 318/722 |
| 4,285,012 | 8/1981 | Ohara et al. | 358/496 |
| 4,302,712 | 11/1981 | Pritchard | 318/490 |
| 4,312,007 | 1/1982 | Winfield | 347/14 |
| 4,584,512 | 4/1986 | Pritchard | 318/696 |
| 4,629,916 | 12/1986 | Oudet | 310/49 R |
| 4,642,494 | 2/1987 | Lundin et al. | 310/49 R |
| 4,652,806 | 3/1987 | Aiello | 318/696 |
| 4,703,243 | 10/1987 | Ettelman et al. | 318/696 |
| 4,710,691 | 12/1987 | Bergstrom et al. | 318/696 |
| 4,739,201 | 4/1988 | Brigham et al. | 310/49 R |
| 4,757,327 | 7/1988 | Henzi | 347/237 |
| 4,975,714 | 12/1990 | Rose | 347/256 |
| 5,225,757 | 7/1993 | Burke | 318/696 |
| 5,264,949 | 11/1993 | Stemmle | 358/472 |
| 5,268,708 | 12/1993 | Harshbarger et al. | 346/134 |
| 5,278,578 | 1/1994 | Baek et al. | 347/240 |
| 5,291,214 | 3/1994 | Baek et al. | 246/139 D |
| 5,329,297 | 7/1994 | Sanger et al. | 347/251 |
| 5,410,200 | 4/1995 | Sakamoto et al. | 310/49 R |
| 5,410,338 | 4/1995 | Jadrich et al. | 347/264 |
| 5,428,371 | 6/1995 | Fox et al. | 347/262 |

OTHER PUBLICATIONS

Compumotor Catalog, Step Motor & Servo Motor Systems and Controls, Parker Motion & Control, Rohnert Park CA No Date.

Compumotor OEM650 Drive and Drive/Indexer User Guide, P/N 88–013157–02A, Compumotor Division, Parker Hannifin Corporation, Rohnert Park, CA No Date.

Data Sheet, IM2000 High Performance Microstepping Controller, Intelligent Motion Systems, Inc., Taftville, CT No Date.

Journal of the Optical Society of America, Mar. 1967, vol. 57, No. 3, pp. 401–406, "Spatial Modulation Transfer in the Human Eye".

*Primary Examiner*—N. Le
*Assistant Examiner*—Anh T. N. Vo
*Attorney, Agent, or Firm*—David A. Novais; Nelson Adrain Blish

[57] ABSTRACT

A method and apparatus are disclosed for scanning a receiving medium (32) in an image processing apparatus (10) that allows a variable number of imaging channels, and printhead motion is provided by a lead screw (250) that is driven by a stepper motor (162). In one embodiment, the receiving medium can be mounted on a rotatable imaging drum (300). In order to advance a printhead (500) at the proper speed for a variable number of channels and to adapt the stepper motor for possible variations in drum rotation speed, encoder pulses from the imaging drum are divided by a programmed value to provide input pulses to a stepper motor controller circuitry at the proper rate. Pulses are counted so as to disable this input to the stepper motor controller after a pre-programmed maximum value is reached. Both the divisor value and the pulse counter value are variable, depending on the number of channels used.

10 Claims, 5 Drawing Sheets

PROGRAMMABLE GEARING CONTROL OF A LEADSCREW FOR A PRINTHEAD HAVING A VARIABLE NUMBER OF CHANNELS

The present application is related to co-pending U.S. patent application Ser. No. U.S. Ser. No. 09/144,123 filed Aug. 31, 1998 by Roger S. Kerr and Robert W. Spurr, entitled LINEAR TRANSLATION SYSTEM DITHERING FOR IMPROVED IMAGE QUALITY OF AN INTENDED IMAGE; U.S. patent application Ser. No. U.S. Ser. No. 09/144,390 filed Aug. 31, 1998 (Attorney Docket No. 78183) by Robert W. Spurr, Roger S. Kerr and Kurt M. Sanger, entitled METHOD OF CONTROLLING A PRINTHEAD MOVEMENT BASED ON A SCREW PITCH TO MINIMIZE SWATH-TO-SWATH ERROR IN AN IMAGE PROCESSING APPARATUS and U.S. patent application Ser. No. U.S. Ser. No. 09/124,331 filed Jul. 29, 1998 by Robert W. Spurr and Seung Ho Baek, entitled METHOD FOR COMPENSATING FOR POSITIONAL ERROR INHERENT TO STEPPER MOTORS RUNNING IN MICROSTEPPING MODE.

FIELD OF THE INVENTION

The present invention relates to a subsystem of an image processing apparatus of a lathe bed scanning type having a printhead mounted on a translation stage that is moved by a lead screw. More specifically, the present invention relates to an apparatus and method for programmable speed control of a stepper motor that drives the lead screw.

BACKGROUND OF THE INVENTION

Pre-press color proofing is a procedure that is used by the printing industry for creating representative images of printed material, without the high cost and time that is required to actually produce printing plates and set up a high-speed, high-volume, printing press to produce a single example of an intended image. These intended images may require several corrections and may need to be reproduced several times to satisfy the requirements of the customers, resulting in a large loss of profits. By utilizing pre-press color proofing time and money can be saved.

One such commercially available image processing apparatus, which is depicted in commonly assigned U.S. Pat. No. 5,268,708 is an image processing apparatus having half-tone color proofing capabilities. This image processing apparatus is arranged to form an intended image on a sheet of thermal print media by transferring dye from a sheet of dye donor material to the thermal print media by applying a sufficient amount of thermal energy to the dye donor material to form an intended image. This image processing apparatus is comprised generally of a material supply assembly or carousel, a lathe bed scanning subsystem (which includes a lathe bed scanning frame, a translation drive, a translation stage member, a printhead, and an imaging drum), and thermal print media and dye donor material exit transports.

The scanning subsystem or write engine of the lathe bed scanning type comprises a mechanism that provides the mechanical actuators, for imaging drum positioning and motion control, to facilitate placement, loading onto, and removal of thermal print media and dye donor material from the imaging drum. The scanning subsystem or write engine provides the scanning function by retaining the thermal print media and dye donor material on the rotating imaging drum, which generates a once per revolution timing signal to data path electronics as a clock signal, while the translation drive traverses the translation stage member and printhead axially along the imaging drum in a coordinated motion with the imaging drum rotating past the printhead. This is done with positional accuracy maintained, to allow precise control of the placement of each pixel, in order to produce the intended image on the thermal print media.

The lathe bed scanning frame provides the structure to support the imaging drum and its rotational drive. The translation drive with the translation stage member and printhead are supported by two translation bearing rods that are substantially straight along their longitudinal axis and are positioned parallel to the vacuum imaging drum and a lead screw. Consequently, they are parallel to each other therein forming a plane, along with the imaging drum and lead screw. The translation bearing rods are, in turn, supported by outside walls of the lathe bed scanning frame of the lathe bed scanning subsystem or write engine. The translation bearing rods are positioned and aligned therebetween, for permitting low friction movement of the translation stage member and the translation drive. The translation bearing rods are sufficiently rigid for this application, so as not to sag or distort between the mounting points at their ends. They are arranged to be as exactly parallel as is possible with the axis of the imaging drum. The front translation bearing rod is arranged to locate the axis of the printhead precisely on the axis of the imaging drum, with the axis of the printhead located perpendicular, vertical, and horizontal to the axis of the imaging drum. The translation stage member front bearing is arranged to form an inverted "V" and provides only that constraint to the translation stage member. The translation stage member with the printhead mounted on the translation stage member, is held in place by only its own weight. The rear translation bearing rod locates the translation stage member with respect to rotation of the translation stage member about the axis of the front translation bearing rod. This is done so as to provide no over constraint of the translation stage member which might cause it to bind, chatter, or otherwise impart undesirable vibration or jitters to the translation drive or printhead during the writing process causing unacceptable artifacts in the intended image. This is accomplished by the rear bearing which engages the rear translation bearing rod only on a diametrically opposite side of the translation bearing rod on a line perpendicular to a line connecting the centerlines of the front and rear translation bearing rods.

The translation drive is for permitting relative movement of the printhead by synchronizing the motion of the printhead and stage assembly such that the required movement is made smoothly and evenly throughout each rotation of the drum. A clock signal generated by a drum encoder provides the necessary reference signal accurately indicating the position of the drum. This coordinated motion results in the printhead tracing out a helical pattern around the periphery of the drum. The above mentioned motion is accomplished by means of a DC servo motor and encoder which rotates a lead screw that is typically, aligned parallel with the axis of the imaging drum. The printhead is placed on the translation stage member in a "V" shaped groove, which is formed in the translation stage member, which is in precise positional relationship to the bearings for the front translation stage member supported by the front and rear translation bearing rods. The translation bearing rods are positioned parallel to the imaging drum, so that it automatically adopts the preferred orientation with respect to the surface of the imaging drum. The printhead is selectively locatable with respect to the translation stage member, thus it is positioned with respect to the imaging drum surface. By adjusting the distance between the printhead and the drum surface, as well as the angular position of the printhead about its axis using adjustment screws, an accurate means of adjustment for the printhead is provided. Extension springs provide the load against these two adjustment means.

The translation stage member and printhead are attached to a rotatable lead screw (having a threaded shaft) by a drive nut and coupling. The coupling is arranged to accommodate misalignment of the drive nut and lead screw so that only rotational forces and forces parallel to the lead screw are imparted to the translation stage member by the lead screw and drive nut. The lead screw rests between two sides of the lathe bed scanning frame of the lathe bed scanning subsystem or write engine, where it is supported by deep groove radial bearings. At the drive end the lead screw continues through the deep groove radial bearing, through a pair of spring retainers, that are separated and loaded by a compression spring to provide axial loading, and to a DC servo drive motor and encoder. The DC servo drive motor induces rotation to the lead screw moving the translation stage member and printhead along the threaded shaft as the lead screw is rotated. The lateral directional movement of the printhead is controlled by switching the direction of rotation of the DC servo drive motor and thus the lead screw.

The printhead includes a plurality of laser diodes which are coupled to the print-head by fiber optic cables which can be individually modulated to supply energy to selected areas of the thermal print media in accordance with an information signal. The printhead of the image processing apparatus includes a plurality of optical fibers coupled to the laser diodes at one end and the other end to a fiber optic array within the printhead. The printhead is movable relative to the longitudinal axis of the imaging drum. The dye is transferred to the thermal print media as the radiation, transferred from the laser diodes by the optical fibers to the printhead and thus to the dye donor material is converted to thermal energy in the dye donor material.

The design of scanning subsystems for image processing apparatuses presents strict constraints. Chief among these are the following:

- There is a requirement for precision timing so that the imaged dots are written in the intended location on the receiving medium, with acceptable error tolerances typically on the order of a few microns;
- One must compensate for some irregularity in imaging drum rotational speed, so that the translation drive may need to be dynamically sped-up or slowed down to provide the required printhead position; and
- One must be able to adapt to writing using a variable number of channels. As noted in U.S. Pat. No. 5,329,297, there can be specific halftone screen patterns that cause inherent problems when imaged with specific number of channels (swath width) due to "beat frequency" problems.

Conventional solutions to the above-listed design constraints are known to be relatively expensive and inflexible. The use of a servo motor mechanism, as described above for the device disclosed in U.S. Pat. No. 5,268,708, is workable, but is expensive since a servo system requires a precision feedback loop. To adapt to imaging using a variable number of channels, a printer controller subsystem is used to adjust both the imaging drum speed and corresponding servo motor speed for the translation subsystem, as is disclosed in U.S. Pat. No. 5,329,297.

A less expensive alternative to the servo subsystem described above is to use a stepper motor for the translation system. This approach is less expensive and allows the translation subsystem to be operated "open-loop" (that is, without requiring feedback components for motor timing). However, the stepper motor must be controlled so that it repeatably provides the precise speed needed to write the image using a variable number of channels. The stepper motor must also be controlled with precise timing, so that printhead travel speed adjusts for small changes in imaging drum speed and thus maintains positional accuracy.

SUMMARY OF THE INVENTION

The present invention is directed to overcoming the problems and drawbacks described above.

It is an object of the present invention to programmably adjust a rotational speed of a stepper motor, and hence, a linear speed of the printhead translation assembly, so that a translation subsystem allows the printhead to write using a variable number of channels.

It is a further object of the present invention to control printhead traversal speed in a manner that is dynamic, responding to changes or "flutter" in drum speed.

An advantage of the present invention is that it allows the printhead to write using an integral number of channels that is variable, so that a single mechanical design supports imaging at an optimal number of channels for the characteristics of the final output. Moreover, the number of channels can be different for each pass or color separation produced by the imaging apparatus.

A further advantage of the present invention is that it allows the rotation of the imaging drum to be at a nominally constant speed, so that the stepper motor that drives the translation stage varies its speed based on number of channels used.

A further advantage of the present invention is that it provides cost savings over existing methods for printhead speed control, since it eliminates the need for costly circuitry that adapts imaging drum speed to the speed of the printhead translation assembly.

In accordance with one aspect of the invention, there is provided a method for programmably controlling a rotation of a stepper motor that drives a printhead translation subsystem in an image processing apparatus, in such a way that allows a variable number of channels to be written at the same time in a swath. Pulses from an encoder on the imaging drum are frequency-divided to provide a pulse chain to stepper motor controller circuitry, with the predetermined divider value varying based on number of channels. A pulse counter is set to allow a variable number of pulses to the stepper motor controller, also based on number channels. A signal from the pulse counter disables the pulse chain to the stepper motor controller so as to stop lead screw rotation at the end of a swath. An encoder index pulse resets the pulse counter and allows the next swath to begin.

The present invention relates to an apparatus for adjusting a traversal speed of a printhead in an imaging processing apparatus that comprises a rotating imaging drum which holds a receiver medium. The apparatus comprises a stepper motor adapted to drive the printhead; a stepper motor controller which drives the stepper motor based on input logic signals that indicate rotation of the imaging drum; an encoder which senses rotational motion of the imaging drum, with the encoder providing a high-resolution feedback signal comprising digital pulses for small increments of rotation of the imaging drum and providing an index pulse that synchronizes each writing swath on the imaging drum; a programmable divide-by-n frequency counter that provides an output pulse for every n encoder pulses sensed, wherein the value of n is predetermined based on the number of writing channels used; and a programmable pulse counter that is loaded with a preset value, and varied based on the number of circuitry channels, with the pulse counter providing a disabling signal when the preset value is reached.

The present invention also relates to a method for adjusting a traversal speed of a printhead in an image processing apparatus that uses a rotating imaging drum which holds a receiver medium and a stepper motor for providing printhead motion. The printhead is adapted to image using a variable number of channels that write generally simultaneously as a swath. The method comprises the steps of calculating a rotational speed of the imaging drum by sensing encoder pulses from an encoder operationally associated with the imaging drum; dividing the encoder pulses using a variable integral divisor that has a programmed value which is predetermined based on the number of channels used; gating output pulses that result from the division up to a programmed maximum value, wherein the maximum value is determined by the number of writing channels, so as to disable the stepper motor controller when said programmed maximum value is reached; and resetting said count of output pulses at a beginning of each imaging swath to re-enable the stepper motor controller.

The present invention also relates to an apparatus for controlling a speed of a printhead in an imaging processing apparatus. The apparatus comprises a stepper motor for driving the printhead along a surface of a rotatable imaging drum; an encoder which senses rotational motion of the imaging drum, with the encoder providing a feedback signal comprising digital pulses for increments of rotation of the imaging drum; and a programmable pulse counter that is loaded with a preset value, with the pulse counter providing a disabling signal when the preset value is reached.

The present invention further relates to an imaging apparatus which comprises a print head; a stepper motor for driving the printhead along a surface of a rotatable imaging drum of the imaging apparatus; an encoder which senses a rotational motion of the imaging drum, with the encoder providing a feedback signal comprising digital encoder pulses for increments of rotation of the imaging drum; and a programmable pulse counter that is loaded with a preset value, with the pulse counter providing a disabling signal when the preset value is reached.

Although not described in detail, it would be obvious to someone skilled in the art that this invention could be used with thermal, laser, inkjet, and other imaging technologies. This invention could be embodied in a number of image markings as well as image sensing scanning applications.

DETAILED DESCRIPTION OF THE INVENTION

Figure 1:
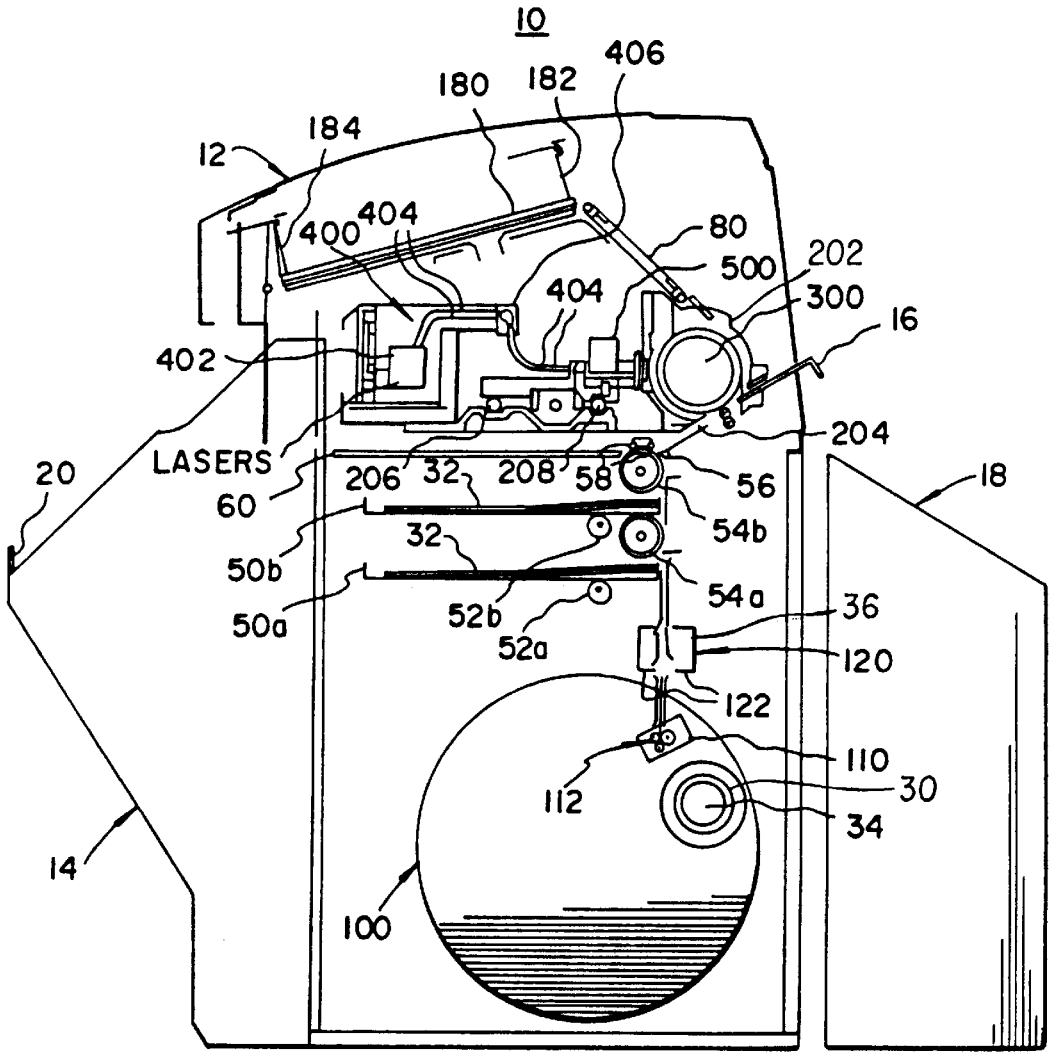
FIG. 1 is a side view in vertical cross section of an image processing apparatus of the present invention.

Referring now to the drawings, wherein like reference numerals represent identical or corresponding parts throughout the several views, FIG. 1 illustrates an image processing apparatus 10 according to the present invention. Image processing apparatus 10 includes an image processor housing 12 which provides a protective cover. A movable, hinged image processor door 14 is attached to a front portion of image processor housing 12 permitting access to two sheet material trays, a lower sheet material tray 50*a* and an upper sheet material tray 50*b*, that are positioned in an interior portion of image processor housing 12 for supporting thermal print media 32, thereon. Only one of sheet material trays 50*a*, 50*b* will dispense thermal print media 32 out of its sheet material tray to create an intended image thereon; the alternate sheet material tray 50*a*, 50*b* either holds an alternative type of thermal print media 32 or functions as a back up sheet material tray. In this regard, lower sheet material tray 50*a* includes a lower media lift cam 52*a* for lifting lower sheet material tray 50*a* and ultimately thermal print media 32, upwardly toward a rotatable, lower media roller 54*a* and toward a second rotatable, upper media roller 54*b* which, when both are rotated, permits thermal print media 32 in lower sheet material tray 50*a* to be pulled upwardly towards a movable media guide 56. Upper sheet material tray 50*b* includes an upper media lift cam 52*b* for lifting upper sheet material tray 50*b* and ultimately thermal print media 32 towards upper media roller 54*b* which directs it towards movable media guide 56.

Movable media guide 56 directs thermal print media 32 under a pair of media guide rollers 58 which engage thermal print media 32 for assisting upper media roller 54*b* in directing it onto a media staging tray 60. Media guide 56 is attached and hinged to a lathe bed scanning frame 202 at one end, and is uninhibited at its other end for permitting multiple positioning of media guide 56. Media guide 56 then rotates its uninhibited end downwardly, as illustrated in the position shown in FIG. 1, and the direction of rotation of upper media roller 54*b* is reversed for moving thermal print media 32 resting on media staging tray 60 under the pair of media guide rollers 58, upwardly through entrance passageway 204 and around a rotatable vacuum imaging drum 300.

A roll 30 of dye donor roll material 34 is connected to media carousel 100 in a lower portion of image processor housing 12. Four rolls of roll media 30 are used, but only one is shown for clarity. Each roll 30 includes a dye donor roll material 34 of a different color, typically black, yellow, magenta and cyan. These dye donor roll materials 34 are ultimately cut into dye donor sheet materials 36 and passed to vacuum imaging drum 300 for forming the medium from which dyes imbedded therein are passed to thermal print media 32 resting thereon, which process is described in detail herein below. In this regard, a media drive mechanism 110 is attached to each roll 30 of dye donor roll material 34, and includes three media drive rollers 112 through which dye donor roll material 34 of interest is metered upwardly into media knife assembly 120. After dye donor roll material 34 reaches a predetermined position, media drive rollers 112 cease driving dye donor roll material 34 and the two media knife blades 122 positioned at a bottom portion of media knife assembly 120 cut dye donor roll material 34 into dye donor sheet materials 36. Lower media roller 54*a* and upper media roller 54*b* along with media guide 56 then pass dye donor sheet material 36 onto media staging tray 60 and ultimately to vacuum imaging drum 300 and in registration with thermal print media 32 using the same process as described above for passing thermal print media 32 onto vacuum imaging drum 300. Dye donor sheet material 36 now rests atop thermal print media 32 with a narrow space or gap between the two created by microbeads imbedded in the surface of thermal print media 32.

A laser assembly 400 includes a quantity of laser diodes 402 in its interior. Lasers 402 are connected via fiber optic cables 404 to a distribution block 406 and ultimately to a printhead 500. Printhead 500 directs thermal energy received from laser diodes 402 causing dye donor sheet material 36 to pass the desired color across the gap to thermal print media 32. Printhead 500 is attached to a lead screw 250 (shown in FIG. 2) via lead screw drive nut 254 and a drive coupling (not shown) for permitting movement axially along the longitudinal axis of vacuum imaging drum 300. This permits a transferring of data to create the intended image onto thermal print media 32. A linear drive motor 258 can be used to drive lead screw 250, while end cap 268 is mounted at the end of lead screw 250.

For writing, vacuum imaging drum 300 rotates at a constant velocity, and printhead 500 begins at one end of thermal print media 32 and traverses the entire length of thermal print media 32 for completing the transfer process for the particular dye donor sheet material 36 resting on thermal print media 32. After printhead 500 has completed the transfer process, for the particular dye donor sheet material 36 resting on thermal print media 32, dye donor sheet material 36 is removed from vacuum imaging drum 300 and transferred out of image processor housing 12 via a skive or ejection chute 16. Dye donor sheet material 36 eventually comes to rest in a waste bin 18 for removal by the user. The above described process is then repeated for the other three rolls 30 of dye donor roll materials 34.

After the color from all four sheets of dye donor materials 36 have been transferred and dye donor materials 36 have been removed from vacuum imaging drum 300, thermal print media 32 is removed from vacuum imaging drum 300 and transported via transport mechanism 80 to a dye binding assembly 180. Entrance door 182 of dye binding assembly 180 is opened for permitting thermal print media 32 to enter the binding assembly 180, and shuts once thermal print media 32 comes to rest in dye binding assembly 180. Dye binding assembly 180 processes thermal print media 32 for further binding the transferred colors on thermal print media 32 and for sealing the microbeads thereon. After the color binding process has been completed, media exit door 184 is opened and thermal print media 32 with the intended image thereon passes out of dye binding assembly 180 and image processor housing 12 and comes to rest against a media stop 20.

Figure 2:
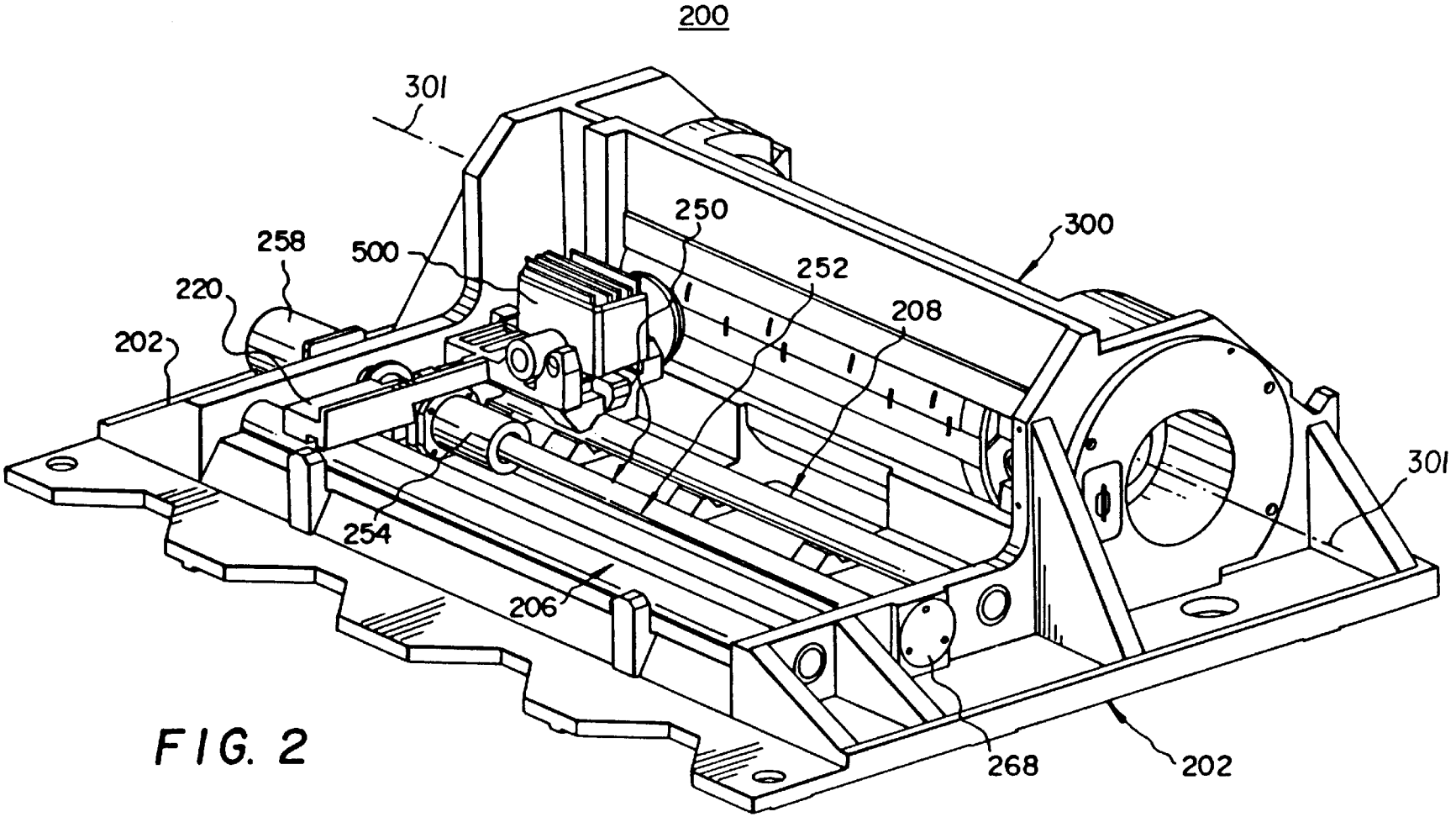
FIG. 2 is a perspective view of the lathe bed scanning subsystem or write engine of the present invention.

Referring to FIG. 2, there is illustrated a perspective view of a lathe bed scanning subsystem 200 of image processing apparatus 10, including vacuum imaging drum 300, printhead 500 and lead screw 250 assembled in lathe bed scanning frame 202. Vacuum imaging drum 300 is mounted for rotation about an axis 301 in lathe bed scanning frame 202. Printhead 500 is movable with respect to vacuum imaging drum 300, and is arranged to direct a beam of light to dye donor sheet material 36. The beam of light from printhead 500 for each laser diode 402 (not shown in FIG. 2) is modulated individually by modulated electronic signals from image processing apparatus 10, which are representative of the shape and color of the original image; so that the color on dye donor sheet material 36 is heated to cause volatilization only in those areas in which its presence is required on thermal print media 32 to reconstruct the shape and color of the original image.

Printhead 500 is mounted on a movable translation stage member 220 which, in turn, is supported for low friction slidable movement on translation bearing rods 206 and 208 (rear and front). Translation bearing rods 206 and 208 are sufficiently rigid so as not to sag or distort as is possible between their mounting points and are arranged as parallel as possible with axis 301 of vacuum imaging drum 300. An axis of printhead 500 is perpendicular to axis 301 of vacuum imaging drum 300. Front translation bearing rod 208 locates translation stage member 220 in vertical and horizontal directions with respect to axis 301 of vacuum imaging drum 300. Rear translation bearing rod 206 locates translation stage member 220 only with respect to rotation of translation stage member 220 about front translation bearing rod 208, so that there is no over-constraint condition of translation stage member 220 which might cause it to bind, chatter, or otherwise impart undesirable vibration or jitters to printhead 500 during the generation of an intended image.

Figure 3:
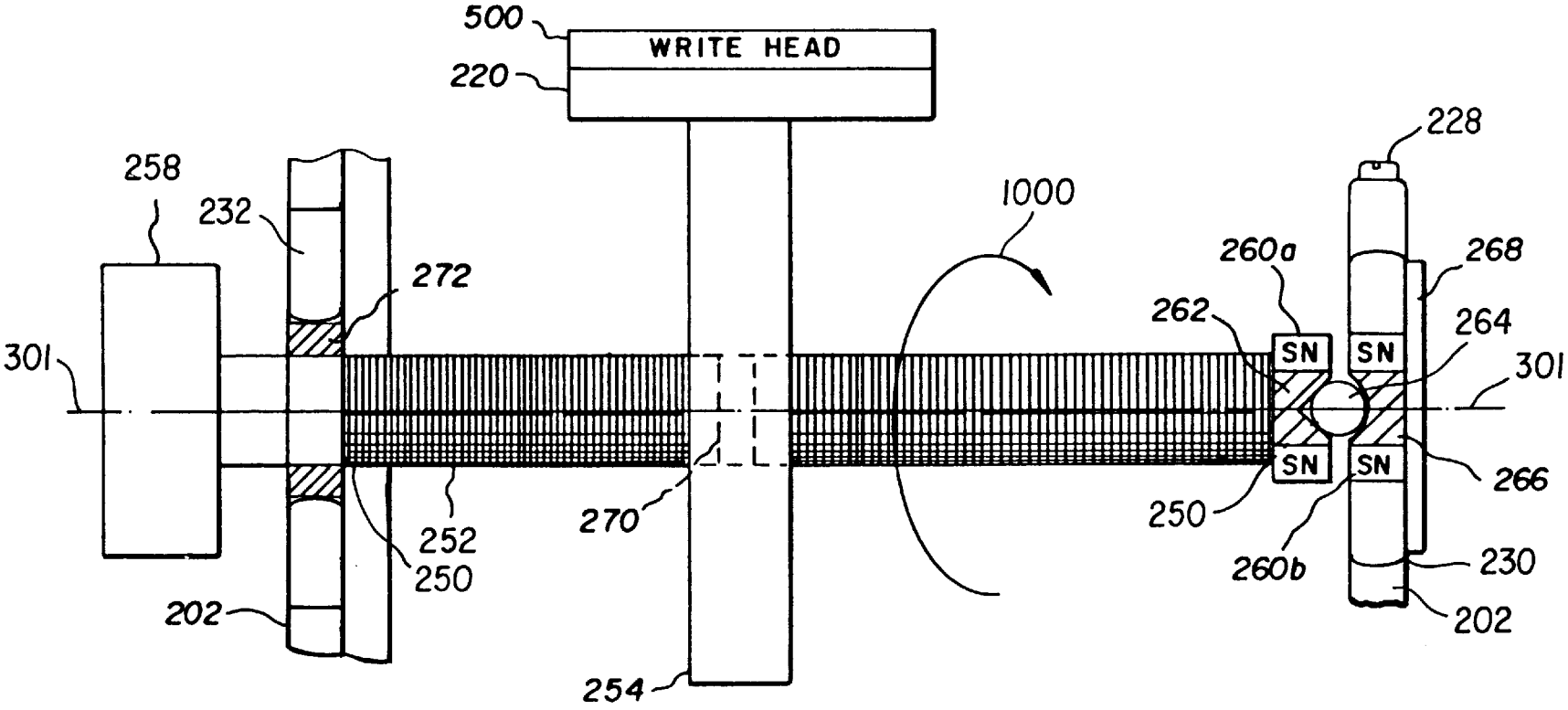
FIG. 3 is a top view in horizontal cross section, partially in phantom, of the lead screw and translation subsystem of the present invention.

Referring to FIGS. 2 and 3, lead screw 250 is shown which includes elongated, threaded shaft 252 which is attached to linear drive motor 258 on its drive end and to lathe bed scanning frame 202 by means of a radial bearing 272. Lead screw drive nut 254 includes grooves in its hollowed-out center portion 270 for mating with the threads of threaded shaft 252 for permitting lead screw drive nut 254 to move axially along threaded shaft 252 as threaded shaft 252 is rotated by linear drive motor 258. Lead screw drive nut 254 is integrally attached to printhead 500 through a lead screw coupling and translation stage member 220 at its periphery, so that as threaded shaft 252 is rotated by linear drive motor 258, lead screw drive nut 254 moves axially along the threaded shaft 252, which in turn moves the translation stage member 220 and ultimately the printhead 500 axially along vacuum imaging drum 300.

Lead screw 250 operates as follows. Linear drive motor 258 is energized and imparts rotation to lead screw 250, as indicated by the arrow 1000 in FIG. 1, causing lead screw drive nut 254 to move axially along threaded shaft 252. Annular-shaped axial load magnets 260*a* and 260*b* are magnetically attracted to each other which prevents axial movement of lead screw 250. Ball bearing 264, however, permits rotation of lead screw 250 while maintaining the positional relationship of annular-shaped axial load magnets 260*a*, 260*b*, i.e., slightly spaced apart, which prevents mechanical friction between them while obviously permitting threaded shaft 252 to rotate.

Figure 4:
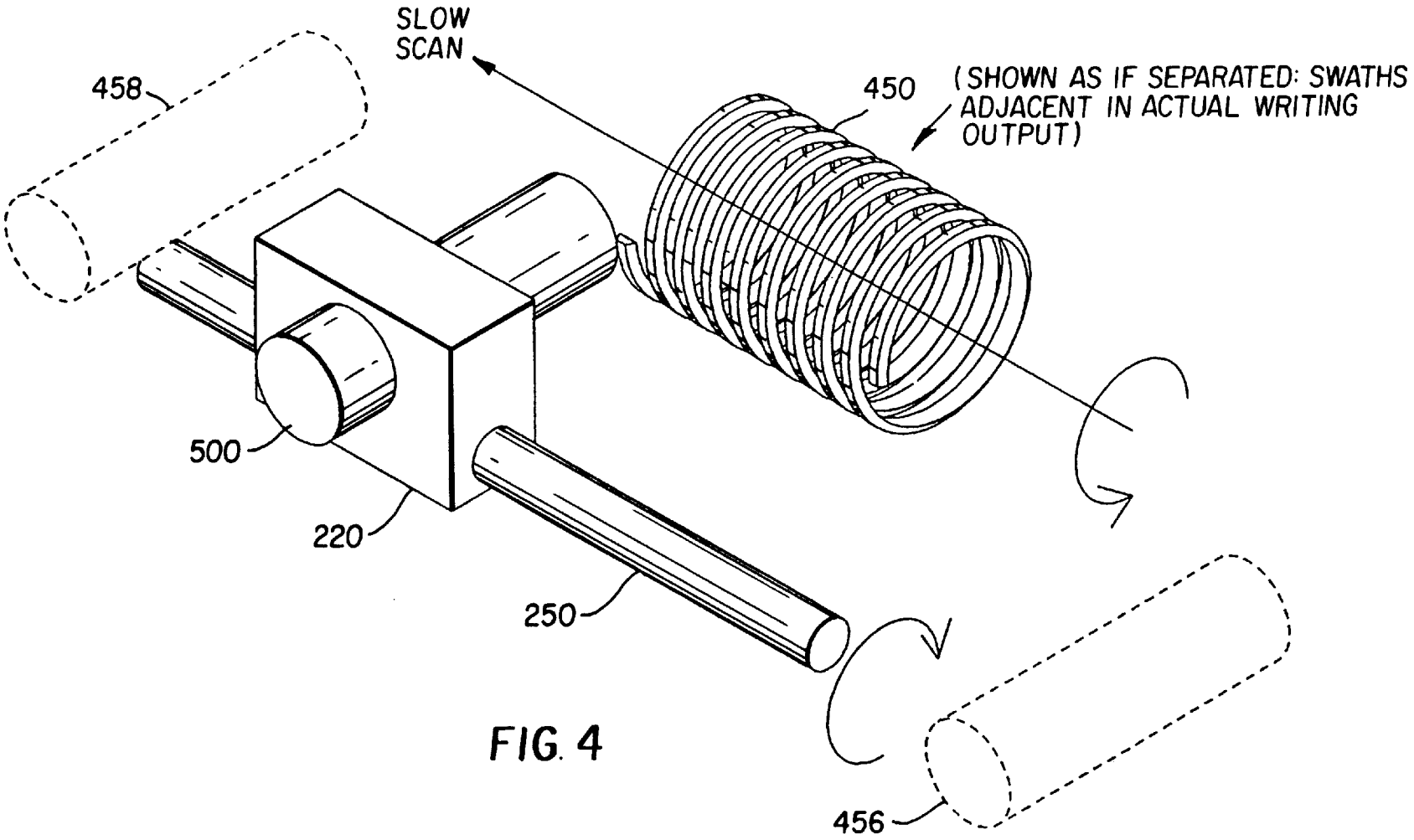
FIG. 4 shows the generally helical pattern of swaths as printed onto the drum-mounted receiver medium by the printhead.

Printhead 500 travels in a path along vacuum imaging drum 300, while being moved at a speed synchronous with a rotation of vacuum imaging drum 300 rotation and proportional to the width of a writing swath 450, shown in FIG. 4. The pattern that printhead 500 transfers to thermal print media 32 along vacuum imaging drum 300, is a helix. FIG. 4 illustrates the principle for generating writing swaths 450 in this helical pattern. (This figure is not to scale; the writing swath 450 itself is typically 250–300 microns wide.) Reference numeral 456 in FIG. 4 represents a position of printhead 500 at the beginning of the helix, while reference numeral 458 represents a position of printhead 500 at the end of the helix.

As is disclosed in U.S. Pat. No. 5,329,297 the capability to image with a variable swath width (that is, using a different number of channels) is particularly advantageous when generating halftone proofs, since it allows the image processing apparatus to use swath widths that do not cause visible frequency "beats" in the generated image. For any number of channels used, printhead traversal speed changes correspondingly. This requires that the control subsystem for printhead movement be able to adjust printhead speed based on number of channels. Additionally, the control subsystem for printhead movement must also be capable of adjusting dynamically to slight rotational speed changes (or "flutter") in vacuum imaging drum 300 rotation.

Figure 5:
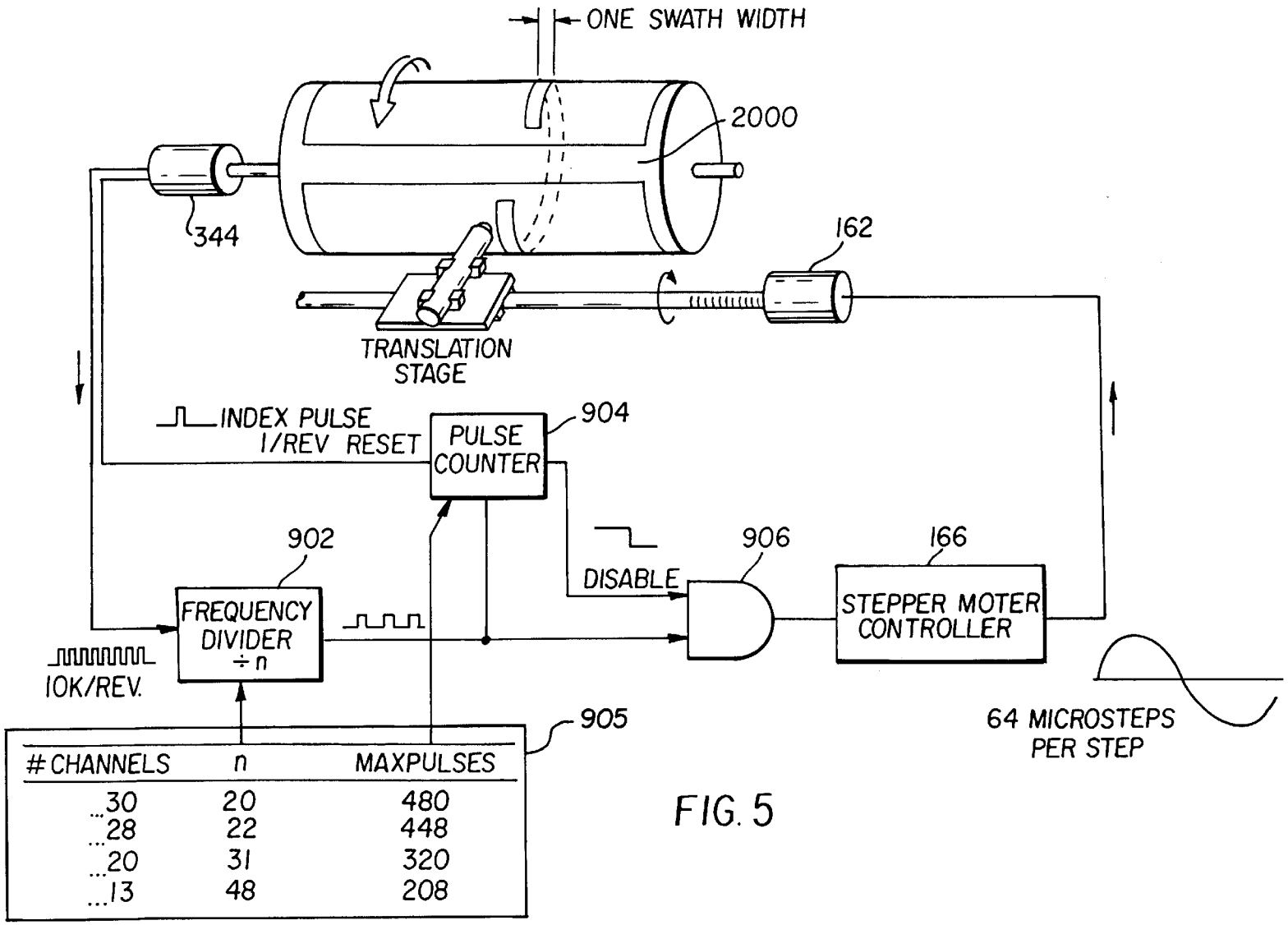
FIG. 5 is a block diagram that shows the circuit logic used for programmable gearing as disclosed in this invention.

The control circuitry shown in the block diagram of FIG. 5 shows how the present invention adjusts printhead 500 traversal speed programmably (based on the number of channels) and dynamically (responding to changes in vacuum imaging drum rotational speed). To drive lead screw 250, the present invention uses a stepper motor 162 (FIG. 5) that is driven in microstepping mode.

A concurrent application entitled "Method for Compensating for Positional Error Inherent to Stepper Motors Running in Microstepping Mode", Attorney Docket No. 78183 discloses how the microstepping mode is used with wave shaping to reduce stepper motor positional error. A second related application, entitled "Method of Controlling a Printhead Movement based on a Lead Screw Pitch to Minimize Swath-to-Swath Error in an Image Processing Apparatus", Attorney Docket No. 78183 discloses how lead screw pitch selection and number of full stepper motor steps per swath can be coordinated so as to minimize swath-to-swath error for any number of channels used.

As is illustrated in FIG. 5, encoder pulses from an imaging drum encoder 344 are input to a programmable frequency divider 902. A programmed divisor (n) is applied to divide the input encoder frequency to a reduced output value. Pulses output from the programmable frequency divider 902 then act as clock pulses to drive a stepper motor controller 166 circuitry. (Stepper motor controller 166 can be a standard component, such as the IM 483 High-Performance Microstepping Controller from Intelligent Motion Systems, Inc.). A pulse counter 904 tracks the number of input clock pulses generated in this circuit. When a programmed threshold value is reached (MAXPULSES), pulse counter 904 disables the clock pulse input to stepper motor controller 166 (using standard AND-gate logic control circuitry 906), effectively stopping stepper motor 162. This MAXPULSES value is reached at the end of each swath 450, so that printhead 500 stops moving while vacuum imaging drum 300 rotates through a "dead band" 2000 (where there is no imaging since there is no receiver media). When ready to begin the next swath 450, drum encoder 344 sends an index pulse. This resets pulse counter 904 and enables the input clock pulses to stepper motor controller 166, thus restarting stepper motor 162 for the next swath 450.

As the above description indicates, the control circuit is programmed with two values (n and MAXPULSES) that vary depending on the number of channels; wherein n is a truncated value equal to encoder resolution divided by desired microsteps per revolution (pulses/microsteps); and MAXPULSES equals the desired number of microsteps per revolution. As the table in FIG. 5 indicates, a 28-channel swath requires an n value of 22 as input to programmable frequency divider 902 with a 10,000 pulse/revolution drum encoder. Pulse counter 904 allows 448 (MAXPULSES) pulses to stepper motor controller 166 before disabling stepper motor controller 166 input. With a 10,000 pulse/revolution drum encoder 344, the first 9,856 pulses, after division by programmable frequency divider 902 value (here, 22), provide 448 pulses to stepper motor 162. This gives the stepper motor 448 microsteps (which, in turn, yields 7 full steps at 64 microsteps per step). Stepper motor 162 rotation is then disabled during the remaining 144 (10,000 minus 9,856) pulses from drum encoder 344. (These 144 pulses occur during the "dead band" between swaths 450.)

The table in FIG. 5 shows typical values for n and MAXPULSES given a variable number of channels. For each case, different values for n and MAXPULSES apply. It should be noted that this invention allows a different number of full steps for each number of channels specified, where each full step comprises a number of microsteps (64 per step in the preferred embodiment of this invention). Programmed values for n and for MAXPULSES, determined in advance, are stored in a programmable memory circuitry 905 so that these values can be accessed and used for a given number of channels.

Using the method of this invention, "programmable gearing", the stepper motor speed changes appropriately, based on the number of channels used. As a result, this method allows controlled stepper motor speed for any number of printhead channels arranged to print in a substantially simultaneous manner.

The control circuitry of this invention also compensates for changes in rotational speed of vacuum imaging drum 300. The index pulse synchronizes the control circuitry for the beginning of each swath 450. Dynamic changes in drum speed change the rate of encoder pulses correspondingly, resulting in accurate reporting of drum rotational position.

Although described for a preferred embodiment, it is clear that this invention could be adapted to other uses for coordinating motion within an image processing apparatus. For example, this invention could be implemented in an imaging device that employs a flat-bed or platen-based device for holding the receiver medium. While the preferred embodiment is clearly for laser thermal imaging, this invention could be applied to an imaging system that uses another type of imaging technology and allows adaptation for a variable number of channels (for example, resistive thermal printhead or inkjet printing systems).

The invention has been described in detail with particular reference to certain preferred embodiments thereof, but it will be understood that variations and modifications can be effected within the spirit and scope of the invention.

PARTS LIST

10. Image processing apparatus
12. Image processor housing
14. Image processor door
16. Donor ejection chute
18. Donor waste bin
20. Media stop
30. Roll media
32. Thermal print media
34. Dye donor roll material
36. Dye donor material
50*a*. Lower sheet material tray
50*b*. Upper sheet material tray
52*a*. Lower media lift cam
52*b*. Upper media lift cam
54. Media rollers
54*a*. Lower media roller
54*b*. Upper media roller
56. Media guide
58. Media guide rollers
60. Media staging tray
80. Transport mechanism
100. Media carousel
110. Media drive mechanism
112. Media drive rollers
120. Media knife assembly
122. Media knife blades
162. Stepper motor
166. Stepper motor controller
180. Color binding assembly
182. Media entrance door

184. Media exit door
200. Lathe bed scanning subsystem
202. Lathe bed scanning frame
204. Entrance passageway
206. Rear translation bearing rod
208. Front translation bearing rod
220. Translation stage member
250. Lead screw
252. Threaded shaft
254. Lead screw drive nut
258. Linear drive motor
260*a*. Axial load magnet
260*b* Axial load magnet
262. Circular-shaped boss
264. Ball bearing
266. Circular-shaped insert
268. End cap
270. Hollowed-out center portion
272. Radial bearing
300. Vacuum imaging drum
301. Axis of rotation
344. Drum encoder
400. Laser assembly
402. Lasers diode
404. Fiber optic cables
406. Distribution block
450. Writing swath
456. Start position
458. End position
500. Printhead
900. Stepper motor control circuit
902. Programmable frequency divider.
904. Pulse counter
905. Memory circuitry
906. AND-gate logic control circuitry
1000. Arrow (rotation)
2000. Dead-Band

What is claimed is:

1. An apparatus for adjusting a traversal speed of a printhead in an imaging processing apparatus that comprises a rotating imaging drum which holds a receiver medium, the apparatus comprising:

a stepper motor which drives said printhead, said printhead writing in a variable number of writing channels;

a stepper motor controller which drives said stepper motor based on input logic signals that indicate rotation of said imaging drum;

an encoder which senses said rotation of said imaging drum, said encoder providing a high-resolution feedback signal comprising digital pulses for increments of said rotation of said imaging drum and providing an index pulse that synchronizes each writing swath on said imaging drum;

a programmable divide-by-n frequency counter that sends an output pulse to a programmable pulse counter and said stepper motor controller for every n digital pulses sensed, wherein a value of n is predetermined based on the number of writing channels used; and wherein said programmable pulse counter is loaded with preset values which are varied based on said number of writing channels, said pulse counter providing a disabling signal to said stepper motor controller when said preset value is reached.

2. An apparatus according to claim 1, wherein said stepper motor runs in a microstepping mode.

3. An apparatus according to claim 1, further comprising:

logic circuitry which receives said output pulses from said divide-by-n frequency counter and provides said output pulses to said stepper motor controller until a disable signal is received from said pulse counter; and memory circuitry that provides said valve of n to said programmable divide-by-n frequency counter and said preset values to said pulse counter based on the number of writing channels used.

4. An image processing apparatus according to claim 1, wherein said preset value is reached at an end of a writing swath, such that said printhead stops moving while said imaging drum rotates through an area where there is no receiver medium.

5. A method of adjusting a traversal speed of a printhead in an image processing apparatus that uses a rotating imaging drum which holds a receiver medium and a stepper motor for providing printhead motion, said printhead using a variable number of channels that write as a swath, the method comprising steps of:

determining a rotational speed of said imaging drum by sensing encoder pulses from an encoder operationally associated with said imaging drum;

dividing said encoder pulses by n, wherein n is a predetermined value based on said number of channels used to produce output pulses;

gating said output pulses for controlling a stepper motor controller; and counting said output pulses from said dividing step up to a programmed maximum value, wherein said programmed maximum value is determined by the number of writing channels, so as to disable the stepper motor controller when said programmed maximum value is reached.

6. A method according to claim 5, comprising the further step of:

resetting said count of output pulses at a beginning of each imaging swath to re-enable the stepper motor controller.

7. A method according to claim 5, wherein said programmed maximum value is reached at an end of a writing swath, such that said printhead stops moving while said imaging drum rotates through an area where there is no receiver medium.

8. An apparatus for controlling a speed of a printhead in an imaging processing apparatus, the apparatus comprising:

a stepper motor for driving said printhead in a microstepping mode along a surface of a rotatable imaging drum;

an encoder which senses rotational motion of said imaging drum, said encoder providing a feedback signal comprising digital pulses for increments of rotation of said imaging drum; and a programmable pulse counter that is loaded with a preset value, said pulse counter providing a disabling signal to said stepper motor when said preset value is reached.

9. An apparatus according to claim 8, further comprising a frequency counter that provides an output pulse to said stepper motor for every n encoder pulse sensed, wherein n is predetermined based on a number of writing channels.

10. An imaging apparatus comprising:

an imaging drum;

a printhead which writes in a variable number of writing channels;

a stepper motor which drives said printhead along a surface of said imaging drum;

an encoder which senses a rotational motion of said imaging drum, said encoder providing a feedback signal comprising digital encoder pulses for increments of rotation of said imaging drum;

a controller which controls a speed of said stepper motor based on the number of writing channels used; and a programmable pulse counter that is loaded with a preset value, wherein said pulse counter provides a disabling signal to said controller when said preset value is reached.

* * * * *